US005228580A

United States Patent [19]

Grange

[11] Patent Number: 5,228,580

[45] Date of Patent: Jul. 20, 1993

[54] HOLDER FOR A SHAVER FOR WET SHAVING

[75] Inventor: Kenneth Grange, London, England

[73] Assignee: Wilkinson Sword Gesellschaft mit beschränkter Haftung, Solingen, Fed. Rep. of Germany

[21] Appl. No.: 782,433

[22] Filed: Oct. 25, 1991

[30] Foreign Application Priority Data

Oct. 27, 1990 [DE] Fed. Rep. of Germany ..... 9014878

[51] Int. Cl.[5] ..... A47F 7/00

[52] U.S. Cl. ..... 211/70.6; 248/127; D6/526

[58] Field of Search ..... 211/60.1, 70.6; 248/158, 176, 309.1, 309.2, 127, 121; D6/526

[56] References Cited

U.S. PATENT DOCUMENTS

| | | | |
|---|---|---|---|
| D. 182,062 | 2/1958 | Cudd | D6/526 |
| D. 185,950 | 8/1959 | Wise | D6/526 |
| D. 221,960 | 9/1971 | Stephenson | D6/526 |
| D. 304,868 | 11/1989 | Spencer | D6/526 X |
| 1,548,717 | 8/1925 | Hall | 248/121 |
| 1,614,011 | 1/1927 | Martins | D6/526 X |
| 1,958,600 | 5/1934 | Wright . | |
| 2,883,062 | 4/1959 | Rosemark | 211/60.1 |
| 3,277,901 | 10/1966 | McElhiney . | |
| 3,486,630 | 12/1969 | Ellman . | |
| 4,936,466 | 6/1990 | Nava | 248/176 X |

FOREIGN PATENT DOCUMENTS 659965 4/1938 Fed. Rep. of Germany ... 248/309.2

OTHER PUBLICATIONS

From House Beautiful magazine: "Shave-Rack" advertised by Sheldon Plastic Sales Co. May 1949 p. 75.

*Primary Examiner*—David A. Scherbel
*Assistant Examiner*—Derek J. Berger
*Attorney, Agent, or Firm*—Robert W. Becker & Associates

[57] ABSTRACT

A holder for holding a shaver for wet-shaving and a box-shaped dispenser for razor-blade units is provided. The holder consists of a base portion, a post with a holding arrangement connected to the base portion for suspending the shaver, and a receptacle for the box-shaped dispenser whereby the receptacle is in the form of a slot-shaped recess provided at the base portion.

7 Claims, 1 Drawing Sheet

HOLDER FOR A SHAVER FOR WET SHAVING

BACKGROUND OF THE INVENTION

The present invention relates to a holder for holding a shaver for wet-shaving and a dispenser for razor-blade units.

Shavers for wet-shaving are well known. In general, they comprise at a front end of a handle a shaver head for receiving single or double razor-blades. In a special embodiment such shavers are provided with so-called razor-blade units. These razor-blade units are separate components in which a single or double razor-blade is fixedly embedded within a plastic body. The razor-blade units are exchangeably attached to the shaver head of the shaver by a respective fastening mechanism. To facilitate storage of such razor-blade units it is well known to provide them in respective dispensers.

A disadvantage of the known shavers is that when not in use they must be placed somewhere. Due to the sharp edge of the razor-blades the casual placement of the respective shavers is a great potential source of injury.

It is therefore an object of the present invention to provide a means for securely storing the shaver together with a dispenser for razor-blade units when the shaver is not in use.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
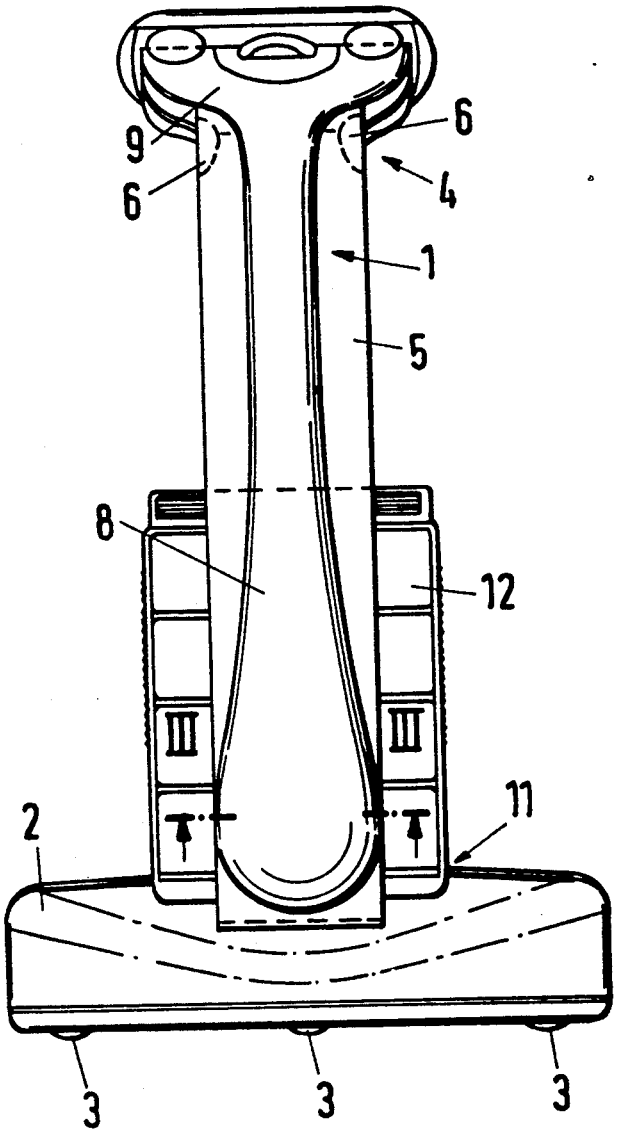
FIG. 1 shows an end view of the holder with the suspended shaver.

The holder for a shaver for wet shaving according to the present invention is primarily characterized by a base portion; a holding means disposed at the base portion for suspending the shaver; and a means for receiving box-shaped dispensers for razor-blade units whereby the receiving means is in the form of a slot-shaped recess provided at the base portion.

With the inventive holder a means for the secure storage of a shaver for wet-shaving when not in use is provided. A special holding means is provided which receives the shaver when it is not in use. The shaver thus has a given or determined location when not in use and may be stored in a secure place. The given location further ensures that the user will always be able to find the shaver without necessitating an extended search due to unintentional misplacement of the shaver.

In a first embodiment the base portion is a part to be placed on a horizontal surface. The holding device may thus be placed onto a vanity or table top in the bathroom or dressing room. Preferably, the base portion has three contact points for contacting the horizontal surface. The three contact points provide a secure positioning of the base portion so that the holder will not be unsteady. Due to the three contact points the base portion preferably may have a triangular shape.

As an alternative to the embodiment of the holder for a horizontal surface the base portion may also be a part to be suspended from a vertical surface. The part to be suspended may, for example, be fastened to the wall by an adhesive layer or similar means so that the holding device for the shaver has a permanent fixed position.

The holder may be embodied as a one-piece plastic article. In a preferred embodiment of the holder, the holding means is provided as a separate formed plastic part usually of a flat design which with one end thereof is connected to the base portion. This embodiment is advantageous for the respective manufacturing process, especially when the base portion and the holding means are manufactured from different materials or when different colorations of the base portion and the holding means are desired. Furthermore it is possible to provide a single base portion with various holding means for various shaver designs. The fixation of the holding means to the base portion may preferably be achieved by simply inserting the holding means and by press-fitting the holding means into the base portion.

Preferably, the holding means is an essentially vertically extending post that widens at a free end thereof. The widened free end provides the holding portion for the shaver head of the shaver. This holding portion is provided with a suspension means. A holding means that employs a post has the advantage that the shaver may be held therein such that its handle is positioned below the holding means so that the space requirements for the storage of the shaver in the horizontal plane are minimal. Furthermore, the user, when gripping the shaver to remove it from the holding means already holds the shaver in a position which corresponds to the shaving position. The user is thus not required to carry out a further handling step after the removal of the shaver from the holding means in order to position the shaver in the correct shaving position for its subsequent use.

The holding portion is in the form of two forked projections that extend laterally and upwardly for suspending the shaver at a transition of the handle of the shaver into the head of the shaver. In order to be able to position the shaver head in a simple procedure within the holding means the forked projections have a funnel-shaped area formed between them. Such forked projections have the advantage that the shaver and especially the shaver head may be placed into the holding means in a very simple manner. The shaver head is supported with its shoulders in the downward direction at the forked projections of the post so that a secure storage is ensured.

In a further embodiment of the post it is suggested that at its free upper end a support for the shaver head is provided. This support improves the stability of the shaver when it is suspended within the holding means. It is preferable, that the support which has a respective supporting surface extends between the projections of the post. Preferably, the supporting surface of the support is adapted to the form of the shaver head and is slanted relative to the forked projections so that between the projections and the supporting surface of the support an angle of approximately 90° is formed. This allows the suspension of modern shavers the head of which is essentially of a triangular shape.

For the secure receiving of the handle of the shaver the post in a preferred embodiment is of a concave cross-section especially in the area of the handle. The handle of the shaver is thus received in a groove-shaped recess so that the stability of the suspended shaver is further improved.

The shaver head of the shaver is provided with exchangeable razor-blade units. Thus, a receiving means for box-shaped dispensers for the razor-blade units is provided. Such a dispenser contains multiple razor-blade units which may be removed when needed while used razor-blade units may be reinserted for proper disposal thereof.

In a preferred constructive embodiment of the receiving means a slot-shaped recess is provided at the base portion into which the dispenser is simply inserted. The dispenser is safely positioned within the holder without it being loosely placed on the respective table or vanity surface.

DESCRIPTION OF PREFERRED EMBODIMENTS

Figure 2:
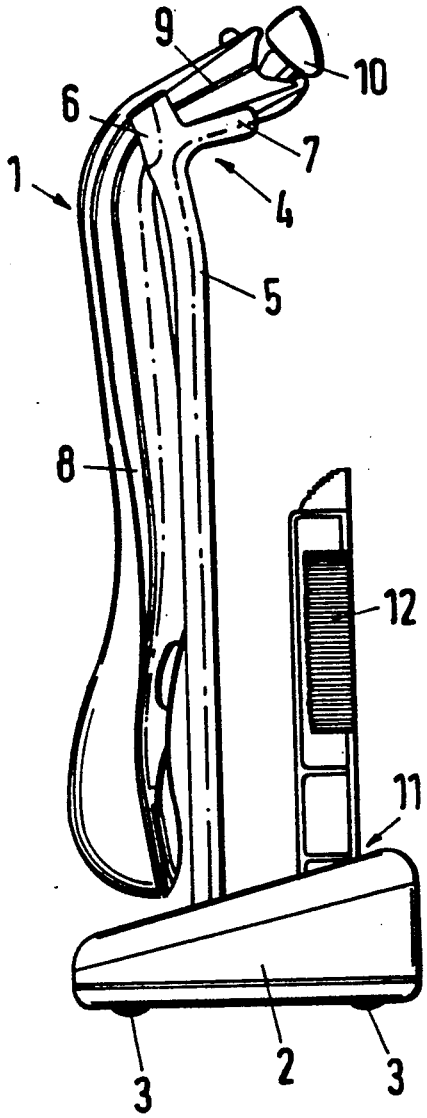
FIG. 2 shows a side view of the holder with the suspended shaver according to FIG. 1.
Figure 3:
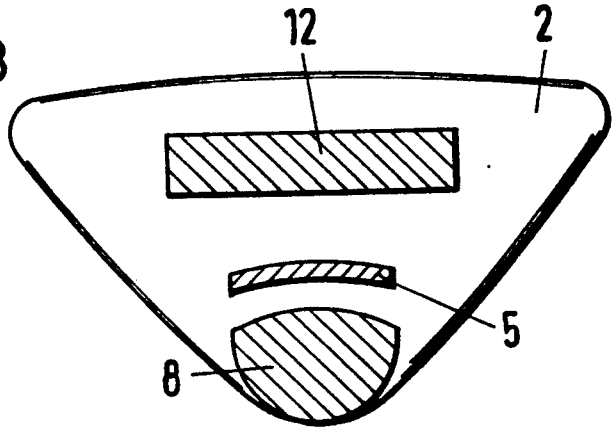
FIG. 3 shows a cross-sectional view along the lines III—III of FIG. 1.

The present invention will now be described in detail with the aid of several specific embodiments utilizing FIGS. 1 through 3.

The holder for a shaver for wet-shaving 1 comprises essentially a base portion 2 in the form of a formed plastic part. This base portion 2 is designed to be placed on a horizontal surface and is positioned on a flat bottom surface. For this purpose the base portion 2 is provided at its underside with three contact points 3 which form the corners of a triangle. As can be seen especially in the representation according to FIG. 3 the base portion 2 is provided with an essentially triangular shape. The upper side of the base portion is slanted towards the front.

The holder comprises further a holding means 4 for the shaver 1 in the form of a suspension device. The holding means 4 comprises a post 5 which is attached to the upper side of the base portion 2 and extends vertically upwardly and widens at its free end. The cross-sectional view of FIG. 3 shows that the post 5 is concave.

At the upper free end of the post 5 two lateral forked projections 6 are provided which are integrally formed with the post 5. These forked projections 6 together form a funnel-shaped opening as can be seen in FIG. 1. Furthermore, the post 5 at its upper free end is provided with a support 7 as can be seen especially in FIG. 2.

The shaver 1 which is suspended from the holding means 4 is provided with a handle 8. The handle 8 has a transition at one end thereof into the shaver head 9. The shaver head 9 is provided with a respective fastening mechanism for attaching the so-called razor-blade units 10. The razor-blade units 10 comprise either a single or double razor-blade that is fixedly embedded within the plastic body of the unit.

When the shaver 1 is suspended within the holder the shaver is inserted from the top into the funnel-shaped opening whereby the handle 8 is inserted first. The funnel-shaped opening is formed by the forked projections 6 of the post 5. Since the width of the shaver head 9 is greater than the distance between the forked projection 6 the shoulders of the shaver head 9 rest at the forked projections 6 such that a sliding in the downward direction is prevented. The shaver 1 is thus suspended by its shaver head 9 at the post 5. In order to provide a stable positioning of the shaver, the handle 8 extends essentially vertically and parallel to the post 5.

Furthermore, the upper side of the base portion 2 is provided with a slot-like recess 11. The recess 11 serves to receive a box-shaped dispenser 12 holding a plurality of razor-blade units 10. The dispenser 12 with the razor-blade units 10 may be removed from the recess 11 as desired so that the user can replace a used razor-blade unit 10 by a new unit. Then the user simply positions the dispenser 12 in the recess 11 of the base portion 2.

The present invention is, of course, in no way restricted to the specific disclosure of the specification and drawings, but also encompasses any modifications within the scope of the appended claims.

What is claimed is:

1. A holder in combination with a shaver for wet-shaving, comprising:

a base portion;

a holding means disposed at said base portion for suspending said shaver therein, said holding means being a separate flat post having a first and a second end, said first end connected to said base portion and said second end having two forked projections that extend laterally and upwardly for suspending said shaver at a transition of a handle of said shaver into a head of said shaver; and a means for receiving box-shaped dispensers for razor-blade units, said receiving means being in the form of a slot-shaped recess in said base portion.

2. A holder according to claim 1, wherein said base portion is a part to be placed on a horizontal surface.

3. A holder according to claim 2, wherein said base portion has three contact points for contacting the horizontal surface.

4. A holder according to claim 1, wherein said base portion is a part to be suspended from a vertical surface.

5. A holder according to claim 1, wherein between said projections a funnel-shaped area is formed.

6. A holder according to claim 1, wherein said free end of said post has a support with a supporting surface for supporting said shaver head, said supporting surface being slanted relative to said projections so that between said projections and said supporting surface an angle of approximately 90° is formed.

7. A holder according to claim 1, wherein said post has a concave cross-section.

* * * * *